US010207142B2

(12) United States Patent
Le Nguyen

(10) Patent No.: US 10,207,142 B2
(45) Date of Patent: Feb. 19, 2019

(54) COLLAPSIBLE FREE STANDING EXERCISE APPARATUS

(71) Applicant: Khanh Trinh Le Nguyen, San Gabriel, CA (US)

(72) Inventor: Khanh Trinh Le Nguyen, San Gabriel, CA (US)

( * ) Notice: Subject to any disclaimer, the term of this patent is extended or adjusted under 35 U.S.C. 154(b) by 180 days.

(21) Appl. No.: 15/249,348

(22) Filed: Aug. 27, 2016

(65) Prior Publication Data

US 2018/0056116 A1 Mar. 1, 2018

(51) Int. Cl.

| | |
|---|---|
| ***A63B 1/00*** | (2006.01) |
| ***A63B 22/00*** | (2006.01) |
| ***A63B 21/068*** | (2006.01) |
| ***A63B 23/12*** | (2006.01) |
| ***A63B 21/00*** | (2006.01) |
| ***A63B 3/00*** | (2006.01) |

(52) U.S. Cl.

CPC ..... *A63B 22/0046* (2013.01); *A63B 1/00* (2013.01); *A63B 3/00* (2013.01); *A63B 21/068* (2013.01); *A63B 21/4035* (2015.10); *A63B 23/12* (2013.01); *A63B 23/1218* (2013.01); *A63B 23/1227* (2013.01); *A63B 2208/12* (2013.01); *A63B 2210/50* (2013.01); *A63B 2225/09* (2013.01)

(58) Field of Classification Search

CPC ..... A63B 22/0046; A63B 1/00; A63B 3/00
USPC ..... 482/41, 42
See application file for complete search history.

(56) References Cited

U.S. PATENT DOCUMENTS 515,461 A * 2/1894 Bowen ..... A63B 1/00 297/245
715,530 A * 12/1902 Wallace ..... A63B 1/00 211/206
1,410,149 A * 3/1922 Williams ..... A63B 1/00 482/38
1,757,825 A * 5/1930 Albach ..... A63G 9/00 211/123
2,817,522 A * 12/1957 Margulies ..... A63B 17/00 482/145
3,218,065 A * 11/1965 Anderson ..... A63B 9/00 182/182.4
3,653,658 A * 4/1972 Robertson ..... A63B 3/00 482/23
5,290,209 A * 3/1994 Wilkinson ..... A63B 21/00047 482/121

(Continued)

FOREIGN PATENT DOCUMENTS

CH 621260 A5 * 1/1981 ..... A63B 1/00

*Primary Examiner* — Joshua T Kennedy

(57) ABSTRACT

A collapsible free standing exercise apparatus for performing multiple body weight exercises is disclosed. The collapsible free standing exercise apparatus comprises a pair of hollow vertical bars separated at a predetermined distance via a connector bar assembly removably fastened at a lower portion of each hollow vertical bar. A first handle bar is removably fastened to each vertex joint on each pair of hollow vertical bars and a second handle assembly removably fastened between each pair of hollow vertical bars at a predetermined position via a support section disposed at distal ends of the second handle bar. A method of fixing the collapsible free standing exercise apparatus for use is also disclosed.

13 Claims, 9 Drawing Sheets

(56) References Cited

U.S. PATENT DOCUMENTS

| | | | | | |
|---|---|---|---|---|---|
| 5,697,875 | A * | 12/1997 | Stan | A63B 21/00047 | 482/141 |
| 5,918,698 | A * | 7/1999 | Lunn | E06C 7/423 | 182/107 |
| 6,117,054 | A * | 9/2000 | Soltanpour | A63B 69/0079 | 482/148 |
| 6,165,112 | A * | 12/2000 | Morris | A63B 21/0552 | 482/129 |
| 7,364,530 | B2 * | 4/2008 | Lopez | A63B 21/00047 | 482/35 |
| 8,079,915 | B2 * | 12/2011 | Spencer | A63G 9/00 | 472/118 |
| 2002/0082145 | A1 * | 6/2002 | Hamilton | A63B 3/00 | 482/38 |

* cited by examiner

COLLAPSIBLE FREE STANDING EXERCISE APPARATUS

FIELD OF THE INVENTION

The present invention relates to an exercise apparatus and more particularly related to a collapsible and portable free standing exercise apparatus for both adults and children.

BACKGROUND OF THE INVENTION

The body weight exercising devices and methods are widely used to improve the muscle strength and fitness. These body weight exercises generally do not require any free weights and the user's own weight adds resistance to all the movements of the exercise, and therefore these exercises help in achieving better results for the user to improve the balance, flexibility, and strength of the user. Some of the common body weight exercises such as push-up, pull-up, sit-up, dips and chin-up are regularly attempted using cumbersome specialized equipment's or in-built gym equipment's.

Numerous equipment's are required for a person to carry out all of the basic body weight exercises. If a person has to set his own equipment for a circuit of bodyweight exercises, he has to acquire lot of space and also it is not cost-effective. Further, the equipment should have a configuration to support a user to do all the basic bodyweight exercises without requiring additional accessories. The choice of angle and flexibility to do all the body weight exercises is not easily available in all the prior art systems. Another important requirement for a basic body weight exercising equipment is to provide adaptability for people of all age groups. But in most of the cases, the equipment's are not offering any sort of exercising attributes for children.

The other hand, storage of this equipment's is a major setback as they require enough space to maintain properly. Some equipment's are complex in design and while dismantling, it requires lot of power and time to accomplish. So all the prior art attempts have failed to meet the important factors of a private body weight exercising equipment such as storage space, adaptability for different age groups, transportation, versatility, cost, assembly and disassembly and so on.

Prior art reference U.S. Pat. No. 7,125,371 B2 discloses an adjustable apparatus for performing bodyweight exercises wherein a pair of side frames and handles with a pendulous member helps performing bodyweight exercises. However, this invention has some shortcomings such as providing flexibility, complex design, adaptability and limited support for user weight and resistance with reduced efficiency of the device.

Prior art reference U.S. Pat. No. 5,662,556 A discloses a portable pull-up exercise apparatus with welded extendable upright frame bar supports. However, the apparatus does not help in doing all the bodyweight exercises for the people of all age groups.

In some cases, when a user performs a body weight exercise such as a pull-up exercise using a specialized apparatus, the body resistance will act heavily based on the user weight. Also, user performs the exercise in a plurality of styles and intensities which in turn transfer more weight onto the apparatus. This may lead to failure of most of the working parts of the apparatus.

In light of aforementioned problems of body weight exercising devices, there exists a need for a collapsible free standing indoor exercise device to perform a plurality of body weight exercises in an efficient and convenient method.

SUMMARY OF THE INVENTION

The present invention relates to a lightweight, easy to use, portable and collapsible free standing exercise apparatus to perform a plurality of body weight exercises such as pull-ups, chin-ups, etc.

The collapsible free standing exercise apparatus comprises a pair of hollow vertical bars separated at a predetermined distance via a connector bars removably fastened at a lower portion of each hollow vertical bar on opposing pairs of the hollow vertical bars, wherein the hollow vertical bars are inclined to each other within the pair, wherein an upper vertex joint is defined between each hollow vertical bar. A first handle bar removably fastened to each vertex joint on each pair of hollow vertical bars, wherein the first handle bar is used by a first user to perform body weight exercises and a second handle assembly is removably fastened between each pair of hollow vertical bars at a predetermined position which is used by a second user to perform body weight exercises. A support section disposed at distal ends of the second handle bar is removably fastened across each hollow vertical bar within the pair. An adjustable bar is also provided with collapsible sections fixedly fastened to each hollow vertical bar within the pair at another predetermined position to adjust a distance between each hollow vertical bar within the pair.

In other embodiments, a method of assembling a collapsible free standing exercise apparatus for use is disclosed. The method comprises the steps of removably fastening a pair of hollow vertical bars separated at a predetermined distance via a connector bars, wherein the hollow vertical bars are inclined to each other within the pair, wherein an upper vertex joint is defined between each hollow vertical bar and removably fastening a first handle bar to each vertex joint on each pair of hollow vertical bars, wherein the first handle bar is used by a first user to perform body weight exercises. A second handle assembly is removably fastened to between each pair of hollow vertical bars at a predetermined position. The method also comprises fixedly fastening an adjustable bar with collapsible sections to each hollow vertical bar within the pair at another predetermined position to adjust a distance between each hollow vertical bar within the pair.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION OF THE INVENTION

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
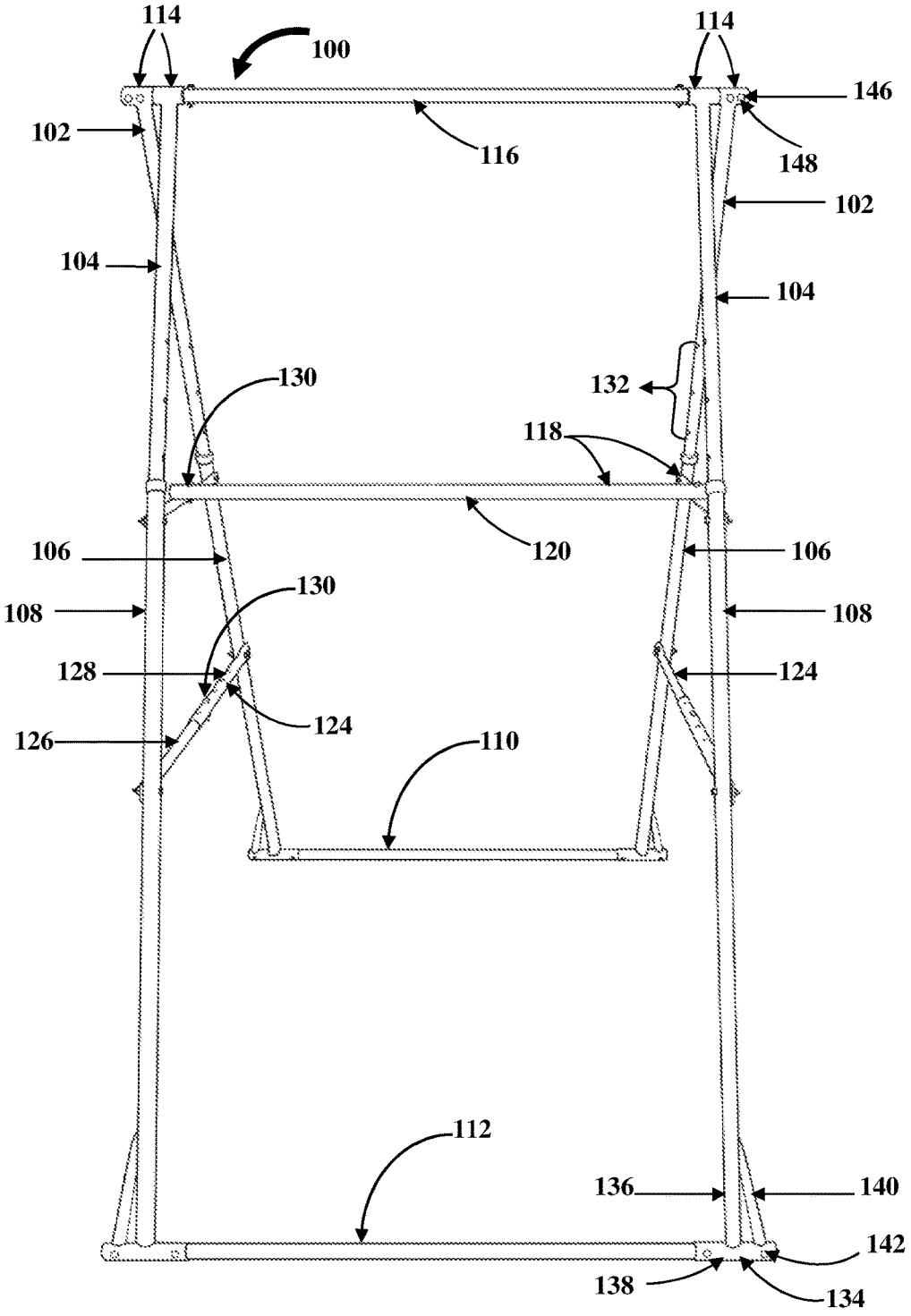
FIG. 1 shows a front view of a collapsible free standing exercise apparatus with a first handle bar and a second handle assembly are assembled, according to an embodiment of the present invention.
Figure 3:
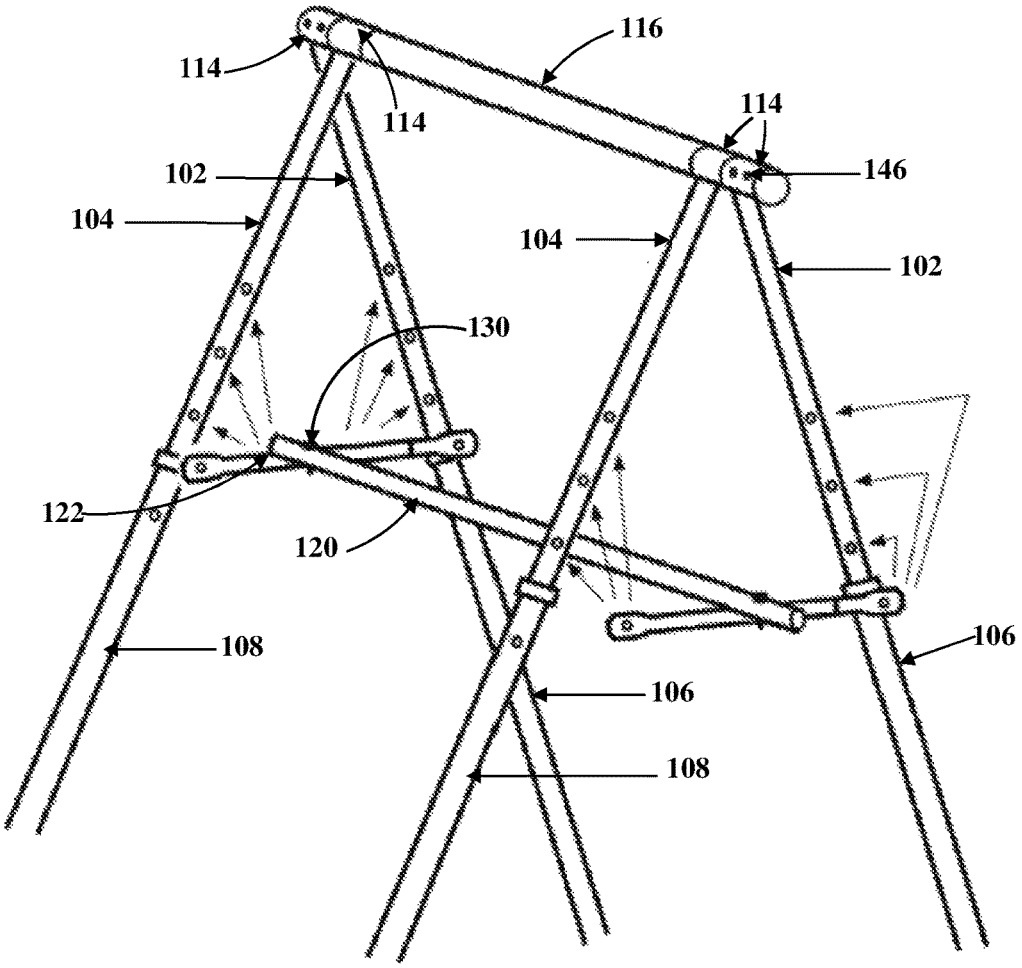
FIG. 3 shows a method of assembling the collapsible free standing exercise apparatus for use, according to an embodiment of the present invention.

Referring to FIG. 1, which shows a front view of a collapsible free standing exercise apparatus 100 with a first handle bar 116 and a second handle assembly 118 assembled to the frame, according to a preferred embodiment of the proposed invention. The collapsible free standing exercise apparatus 100 comprises a pair of hollow vertical bars (102, 104, 106 and 108) separated at a predetermined distance via connector bars (110 and 112) removably fastened at a lower portion of each hollow vertical bar (106 and 108) on opposing pairs of the hollow vertical bars (102, 104, 106 and 108), wherein the hollow vertical bars (102, 104, 106 and 108) are inclined to each other within the pair, wherein an upper vertex joint 114 is defined between each hollow vertical bar (102 and 104). The vertex joint 114 connects the hollow vertical bar 102 and the hollow vertical bar 104. The collapsible free standing exercise apparatus 100 further comprises a first handle bar 116 removably fastened to each vertex joint 114 on each pair of hollow vertical bars (102 and 104), wherein the first handle bar 116 is used by a first user to perform body weight exercises. A second handle assembly 118 is removably fastened between each pair of hollow vertical bars (102, 104, 106 and 108) at a predetermined position wherein the second handle assembly 118 comprises a second handle bar 120 used by a second user to perform body weight exercises and a support section 122 as shown in FIG. 3 is disposed at distal ends of the second handle bar 120. The support section is removably fastened across each hollow vertical bar (102, 104, 106 and 108) within the pair and the second handle bar 120 is removably attached to the support section via a pin member 130 defining the second handle assembly 118. The primary function of support section is configured to lift and connect the second handle bar 120 to each hollow vertical bar (102, 104, 106 and 108) of the collapsible free standing exercise apparatus 100.

Referring to FIG. 1, according to the proposed invention, the collapsible free standing exercise apparatus 100 comprises pairs of hollow vertical bars (102, 104, 106 and 108) which are the primary components of the apparatus 100. The hollow vertical bars (102, 104, 106 and 108) comprises at least two bars in telescopic engagement with each other to selectively adjust the height of the first handle bar 116 removably fastened to each vertex joint 114 on each pair of hollow vertical bars (102 and 104). The hollow vertical bars (102, 104, 106 and 108) comprises a height adjustment mechanism 132 defined by plurality of holes that are evenly spaced to adjust the height of the first handle bar 116. A receiving hole is provided in the hollow vertical bar 102 which matches with that of other hollow vertical bar 106 and a bolt member (not shown) can be inserted to hold them together thereby the height of the first handle bar 116 can be defined. The first handle bar 116 is removably inserted into the vertex joint 114 via a fastening section 146 disposed at distal ends of the vertex joints 114. The fastening section 146 comprises a plurality of holes to receive an anti-rotation pin 148 to secure the first handle bar 116 to each vertex joint 114 on each pair of hollow vertical bars (102 and 104). Whenever, the user wants to adjust the height of the first handle bar 116, the hollow vertical bars (102 and 104) can be pulled out from the other hollow vertical bars (106 and 108) and can be placed on the user-defined level via the anti-rotation pin 148. The first handle bar 116 is primary used for the adults to do their body weight exercises.

Figure 2:
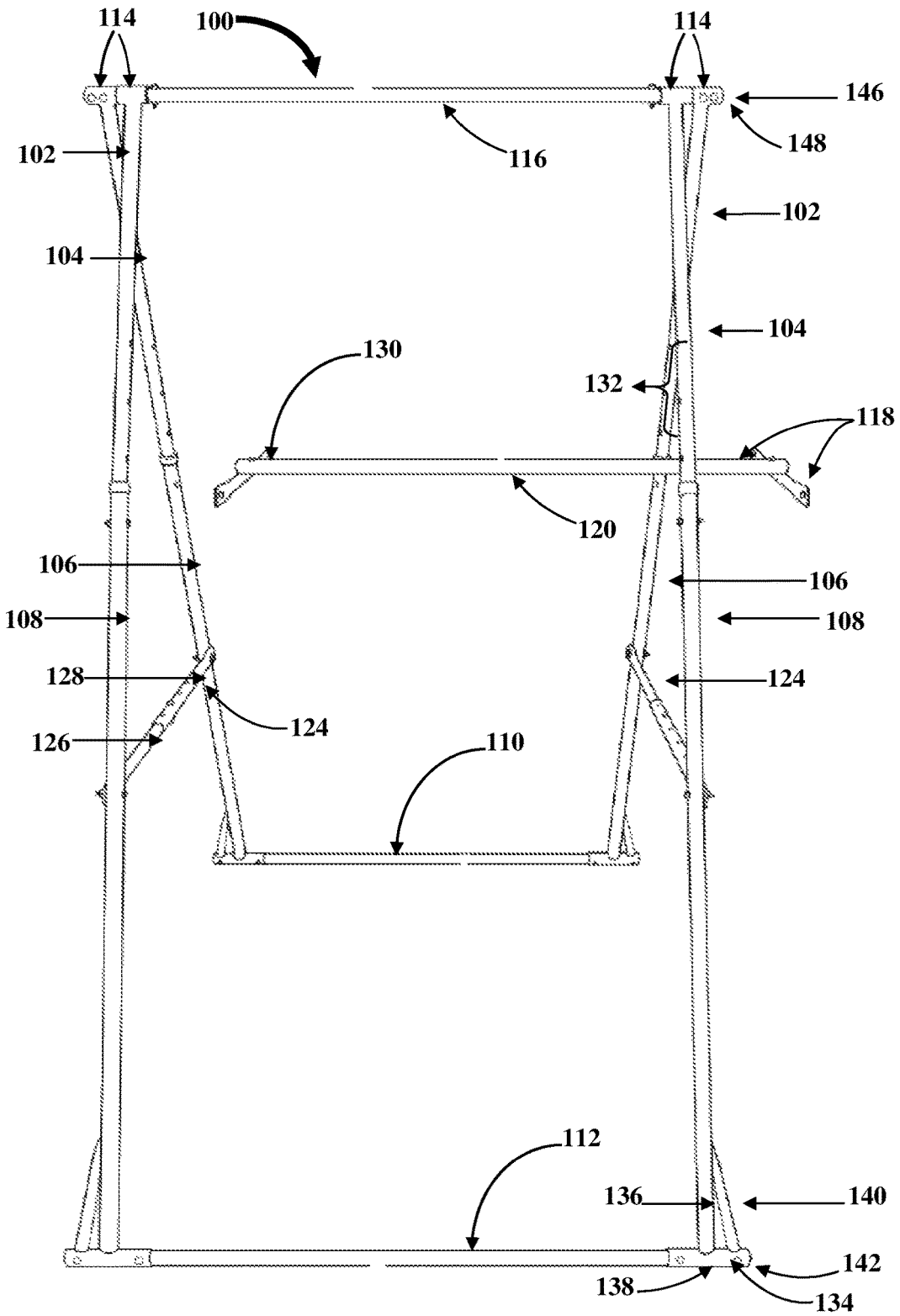
FIG. 2 shows the front view of the collapsible free standing exercise apparatus with the second handle assembly removed from the apparatus, according to an embodiment of the present invention.

Referring to FIG. 2, which shows a front view of a collapsible free standing exercise apparatus 100 with second handle bar 120 removed from the apparatus 100. The collapsible free standing exercise apparatus 100 comprises the first handle bar 116, the second handle bar assembly 118 and a support section to hold the second handle bar 120. The second handle bar 120 is primarily used for children to do their body weight exercises. However, in an exemplary embodiment, the second handle assembly 118 comprising second handle bar 120 and support section can be removed in case if it is not required for use. The support section 122 as shown in FIG. 3 comprises three smaller sections that are inserted into each other to make a distance setting wherein the plurality of holes disposed in each of the smaller sections of the support section helps to adjust the length of the support section. Fastening members like bolts are used to fix the smaller sections of the support section.

According to FIG. 2, the collapsible free standing exercise apparatus 100 also comprises an adjustable bar 124 with collapsible sections (126 and 128) fixedly fastened to each hollow vertical bar (102, 104, 106 and 108) within the pair at another predetermined position to adjust a distance between each hollow vertical bar (102, 104, 106 and 108) within the pair. The adjustable bar 124 is configured to have two sections (126 and 128) in telescopic engagement and comprises plurality of holes to receive the pin member 130 to selectively adjust the length of the adjustable bar 124 thereby defining the distance between the pair of hollow vertical bars (102, 104, 106 and 108). The main function of adjustable bar 124 is to keep the structure of the apparatus 100 rigid on the planar surface whenever the user performs an exercise. The adjustable bar 124 is configured to be fastened to center position of the hollow vertical bars thereby keeping the hollow vertical bars (106 and 108) from not moving on any axis. The fastening members like bolts are used in the holes defined in the sections (126 and 128) in telescopic engagement to adjust the length of the adjustable bar 124. When the user adjusts the height of the first handle bar 116 with respect to desired level without changing the length of the support section, the length of the adjustable bar 124 can be varied flexibly to increase or decrease the height of the first handle bar 116 without affecting the overall structure of the apparatus 100.

Figure 6A:
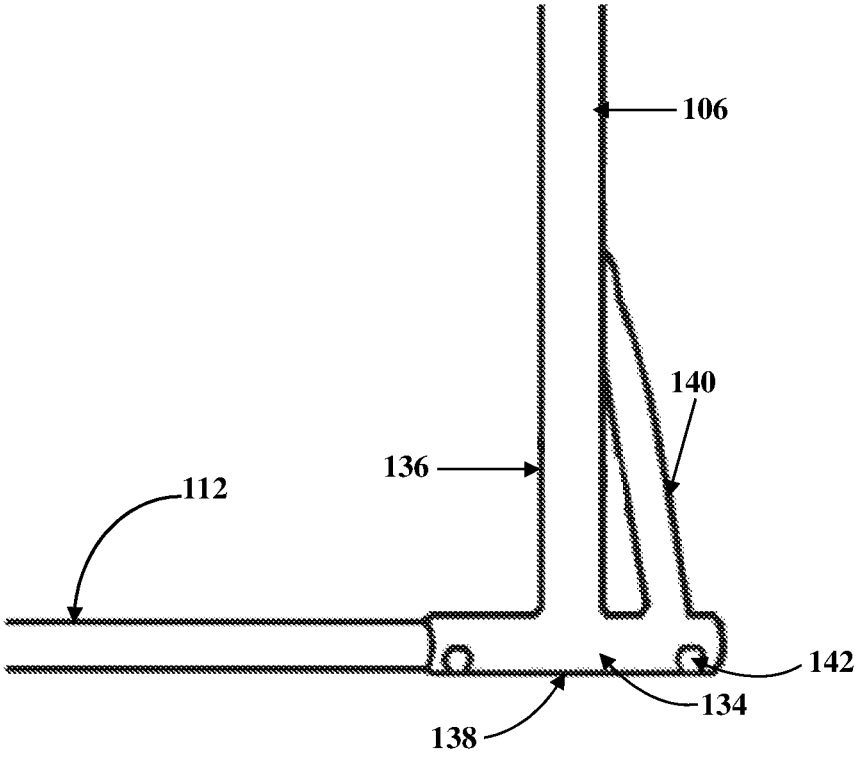
FIG. 6A and FIG. 6B shows a ground engaging cushion member attached to each hollow vertical bar and the connector bars of the collapsible free standing exercise apparatus, according to one embodiment of the present invention.

Referring to FIG. 6A, a ground engaging cushion member 134 attached to hollow vertical bar (106 and 108) and the connector bars (110 and 112) of a collapsible free standing exercise apparatus 100 is disclosed. The ground engaging cushion member 134 is fixedly attached to each hollow vertical bar (106 and 108) and the connector bars (110 and 112), wherein the ground engaging cushion member 134 is configured to compensate the deflection which occurs on each hollow vertical bar (102, 104, 106 and 108) when the user performs the exercise. The ground engaging cushion member 134 is configured to provide compressive strength and bending stiffness to withstand the deflection which occurs on each hollow vertical bar (102, 104, 106 and 108) when the user performs the exercise. The first connector bar 110 and the second connector bar 112 are configured to have varying dimensions. The ground engaging cushion member 134 are provided to eliminate the horizontal and gravitational forces generated by the movements of the user during the exercise tend to increase and affect the overall structure of the apparatus 100 whenever the user does different body weight exercise like chin-ups and pull ups.

Figure 6B:
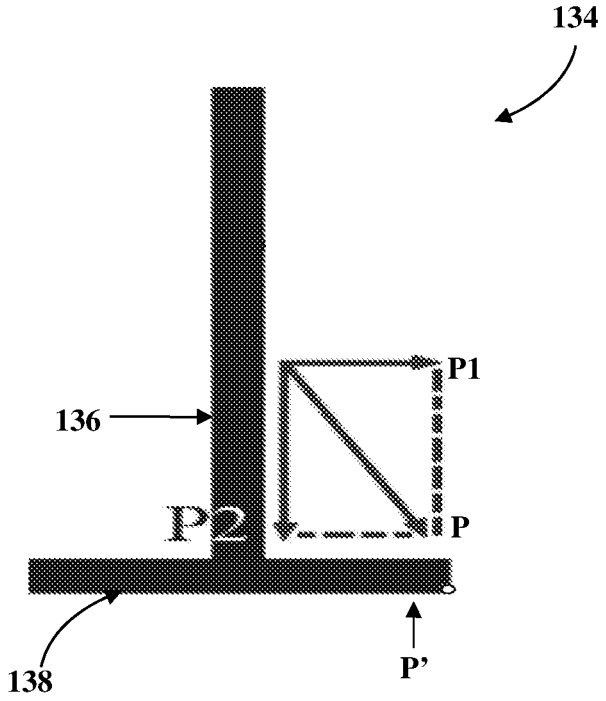

As shown in FIG. 6B, the ground engaging cushion member 134 comprises a vertical section 136 and horizontal section 138 wherein a point P' on the horizontal section is where the horizontal, gravitational and ground reactive forces act to deflect the structure. Therefore, ground engaging cushion member 134 comprises a force-bearing section 140 fixedly attached at an oblique angle to each hollow vertical bar (106 and 108) and the connector bars (110 and 112) to define a shape of a triangle specially to take all the horizontal, gravitational and ground reactive forces partially thereby minimizing the forces acting on the point P and to reduce the vibrations induced on the structure of the apparatus 100. The force-bearing section 140 is welded to the vertical section 136 and horizontal section 138 of the ground engaging cushion member 134 to counteract all the horizontal forces as well as the compression force and traction forces effectively. The force-bearing section 140 generates forces to considerably reduce the compression force and traction force which acts on the entire frame. There is a point P' on the horizontal section 138 of the ground engaging cushion member 134 by which hollow vertical bars 106 and 108) of the whole frame bears the most of the force P which is combined by the horizontal force P1 and the gravitation P2 of the user as shown in FIG. 6B. Further a ground reactive force also may act at the point P' to resist the force P. The more the point P' is farther from the hollow vertical bars (106 and 108), the stronger the force P' is and the weaker the force P is. The bottom surface of force-bearing section 140 which goes inside the connector bars (110 and 112) is fastened to the connector bars (110 and 112).

Figure 4:
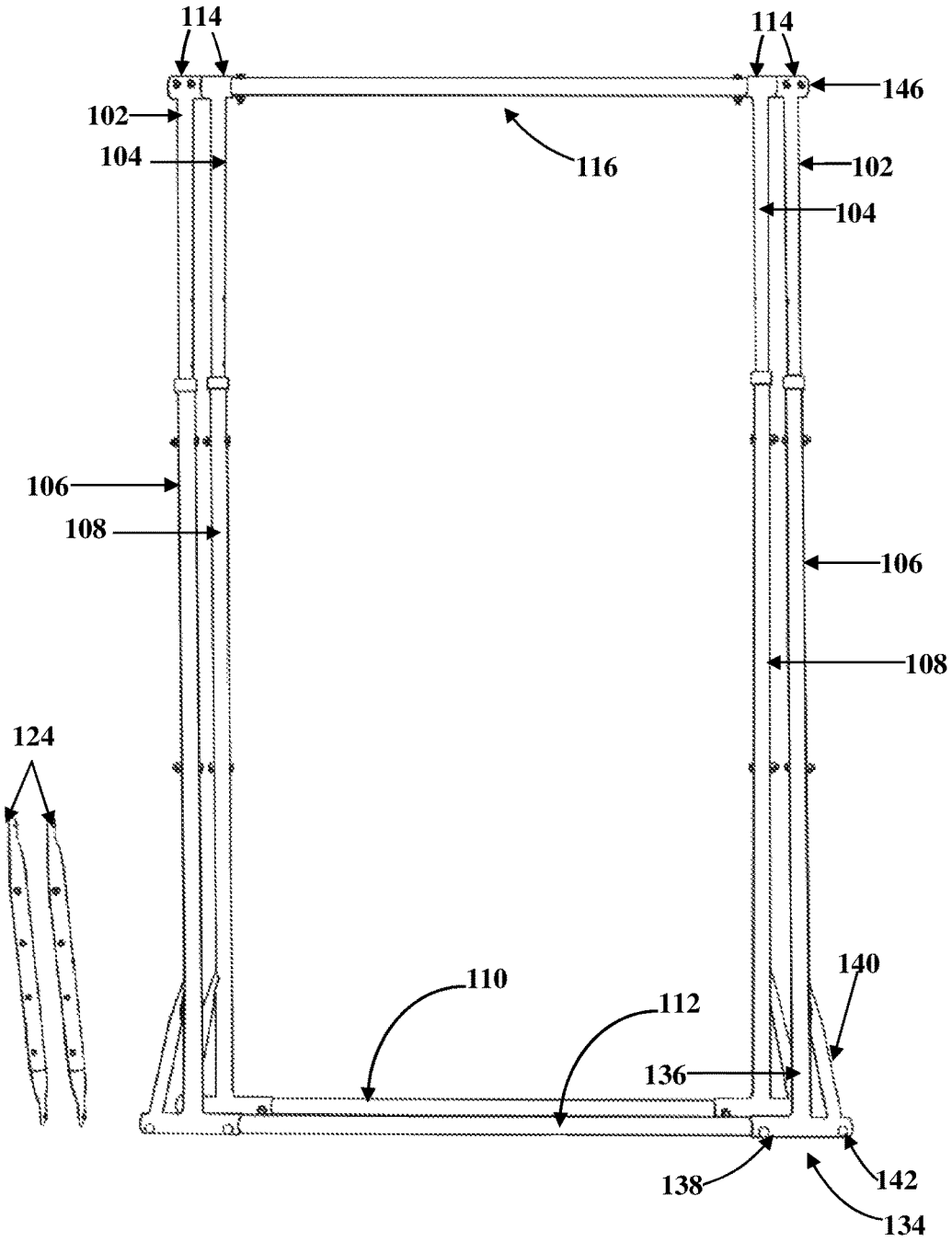
FIG. 4 shows the front view of the collapsible free standing exercise apparatus in a folded state, according to an embodiment of the present invention.

According to FIG. 4, the front view of a collapsible free standing exercise apparatus 100 in folded state, according to an embodiment of the present invention. The connector bars (110 and 112) comprise a first connector bar 110 and a second connector bar 112 to adaptably receive and position each hollow vertical bar (106 and 108) on the ground surface. The first connector bar 110 and the second connector bar 112 are removably inserted into the ground engaging cushion member 134 attached to each vertical hollow member (106 and 108) wherein the plurality of holes 142 defined in the ground engaging cushion member 134 is used to fasten the first connector bar 110 and the second connector bar 112 tightly via the pin member 130.

Figure 5:
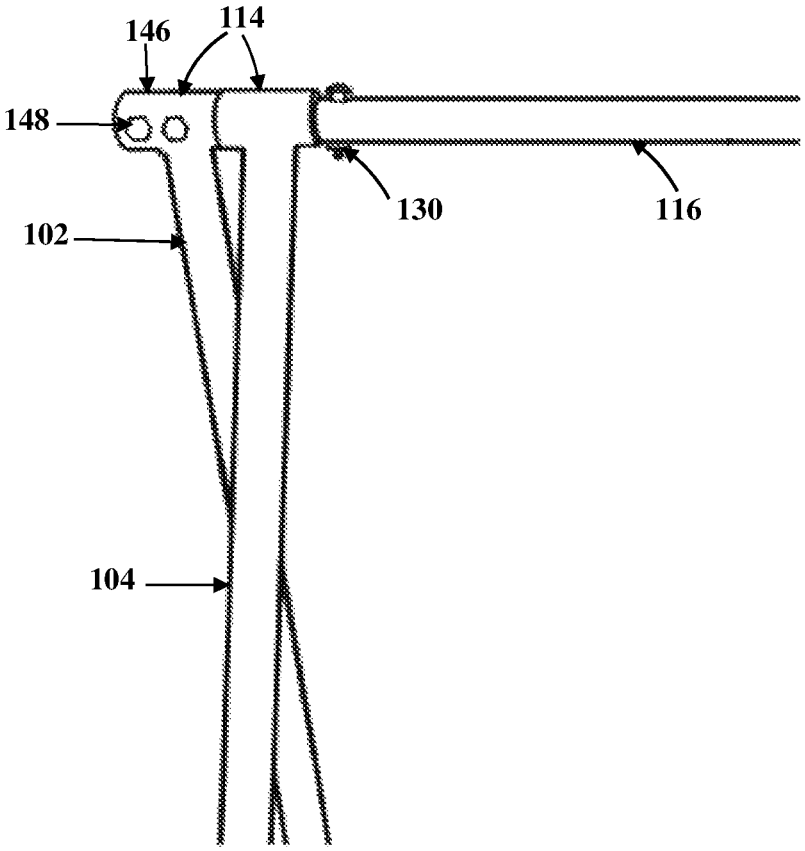
FIG. 5 shows the front view of hollow vertical bars connected to each other by a vertex joint of the collapsible free standing exercise apparatus, according to one embodiment of the present invention.

The pin members 130 will not allow the connector bars (110 and 112) to move from the ground engaging cushion member 134 and also does not allow the anti-slip cushion member 134 from the structure of the apparatus 100. As shown in FIG. 4, the first connector bar 110 is made longer than the second connector bar 112 in length as the distance between each hollow vertical bar (102 and 106) is larger compared to that of each hollow vertical bar (104 and 108) so that the apparatus 100 can be folded easily after removing the support section and adjustable bar 124. As disclosed in FIG. 5, which shows the front view of hollow vertical bars (102 and 104) connected to each other by a vertex joint 114 of a collapsible free standing exercise apparatus 100. The first handle bar 116 is removably fastened to each vertex joint 114 on each pair of hollow vertical bars (102 and 104) via an anti-rotation pin member 148 to prevent the first handle bar 116 to rotate about an axis when the user performs the exercise.

Figure 7A:
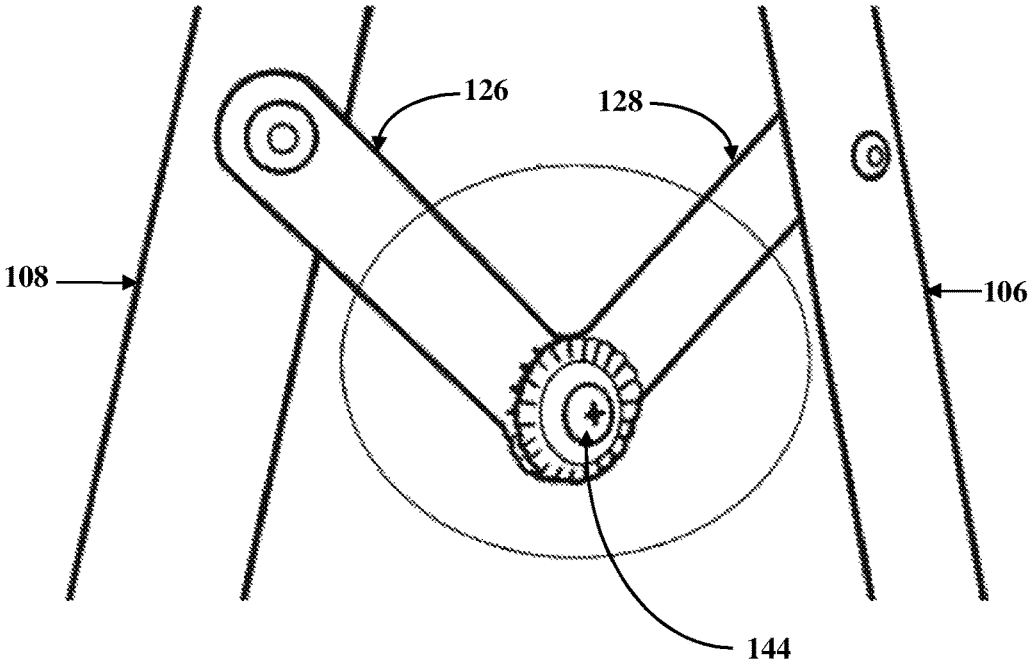
FIG. 7A and FIG. 7B shows an adjustable bar with a screw and collapsible sections of the collapsible free standing exercise apparatus, according to one embodiment of the present invention.
Figure 7B:
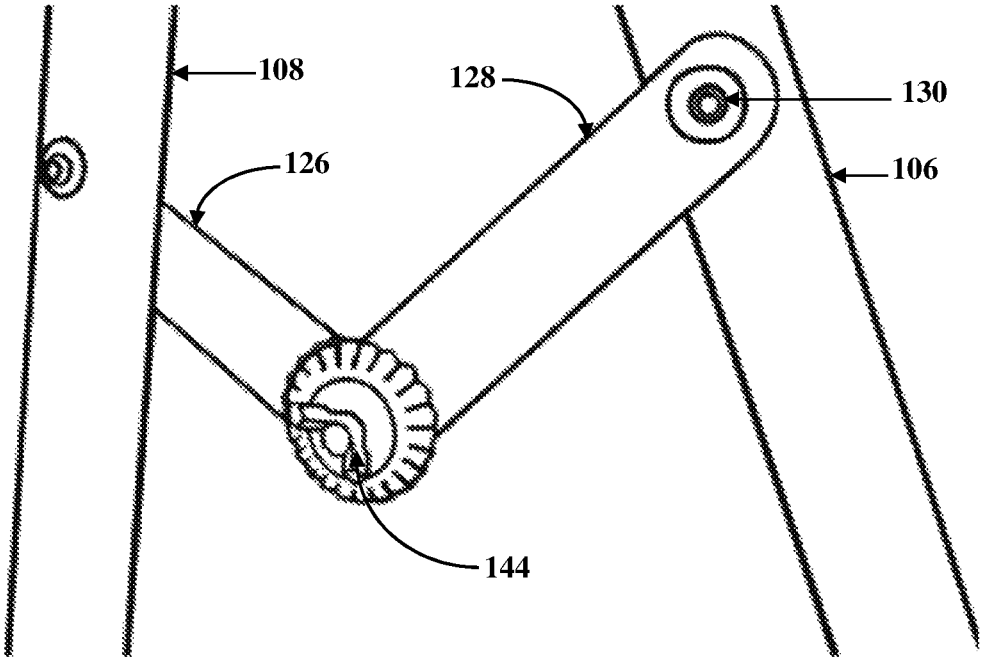

In an exemplary embodiment as shown in FIG. 7A and FIG. 7B, the adjustable bar 124 can be fixedly attached to each hollow vertical bar (102, 104, 106 and 108) and comprises collapsible sections (126 and 128) that can be folded easily whenever the user folds the apparatus 100 after doing the exercise. A screw member 144 is fixedly attached to the center of collapsible sections (126 and 128) so that during the time of folding the apparatus 100, the user can simply turn the screw 144 to fold the collapsible sections (126 and 128) of the adjustable bar 124 without removing the adjustable bar 124 from the frame of the apparatus 100.

According to FIG. 3 and referring back to FIG. 1, a method of assembling a collapsible free standing exercise apparatus 100 for use is disclosed. The method comprises the steps of removably fastening a pair of hollow vertical bars (102, 104, 106 and 108) separated at a predetermined distance via a connector bars (110 and 112), wherein the hollow vertical bars (102, 104, 106 and 108) are inclined to each other within the pair, wherein an upper vertex joint 114 is defined between each hollow vertical bar (102 and 104) and removably fastening a first handle bar 116 to each vertex joint 114 on each pair of hollow vertical bars (102 and 104), wherein the first handle bar 116 is used by a first user to perform body weight exercises. The method further comprises removably fastening a second handle assembly 118 between each pair of hollow vertical bars (102, 104, 106 and 108) at a predetermined position, wherein the second handle assembly 118 comprises a second handle bar 120 used by a second user to perform body weight exercises.

A support section 122 as shown in FIG. 3 is disposed at distal ends of the second handle bar 120, wherein the support section is removably fastened across each hollow vertical bar (102, 104, 106 and 108) within the pair and fixedly fastening adjustable bar 124 with collapsible sections (126 and 128) to each hollow vertical bar (102, 104, 106 and 108) within the pair at another predetermined position to adjust a distance between each hollow vertical bar (102, 104, 106 and 108) within the pair. The method further comprises fastening each hollow vertical bar (102 and 104) to the upper vertex joint 114 via an anti-rotation pin member 130 to prevent the first handle bar 116 to rotate about an axis when the user performs the exercise.

The connector bars (110 and 112) are inserted into the ground engaging cushion member 134 and fastening via the pin member 130 to firmly place the exercise apparatus 100 on a planar surface and fixedly attaching a ground engaging cushion member 134 to each hollow vertical bar (106 and 108) and the connector bars (110 and 112) to compensate the deflection which occurs on each hollow vertical bar (102, 104, 106 and 108) when the user performs the exercise. A force-bearing section 140 is fixedly attached to each hollow vertical bar (106 and 108) and the connector bars (110 and 112) at an oblique angle to compensate the horizontal and traction forces generated by the hollow vertical bars (102, 104, 106 and 108) and the connector bars (110 and 112). Fastening member like bolts can be used on all sections of the apparatus 100 wherever the tightening of the components is required to assemble the apparatus 100.

Referring back to FIG. 3, the method also comprises plurality of fastening members used for matching the different holes positioned in each hollow vertical bar (102, 104, 106 and 108) is selected from at least one of a bolt, nut, screw and pin. In an exemplary embodiment, the user can adjust all the bars and sections of the apparatus 100 based on their requirements. For example, for shorter users, each of the smaller sections of the support section are adaptively positioned on each hollow vertical bar (102, 104, 106 and 108) according to the position of their hand when it reaches the second handle bar 120. In some cases, if the user wants to change the height slightly to do the exercise flexibly, the user can fix any one of the smaller sections of the support section to define the distance setting between each hollow vertical bar (102, 104, 106 and 108). The A-shaped frame of the apparatus 100 can also be changed accordingly when the adjustable bar 124 and it collapsible sections (126 and 128) are adjusted and matched with their holes using the pin member 130.

The collapsible free standing exercise apparatus 100, according to the proposed invention, user can easily adjust the height of both the first handle bar 116 and second handle bar 120 without the help of a spanner and therefore the apparatus 100 can be meet the requirements of many users at all ages with many different heights. The higher user or adults can use the first handle bar 116 and shorter user such as children or woman can use the second handle bar 120 whenever needed. The user can remove the second handle bar 120 when it is not needed with the help of easily adjustable second handle bar assembly 118. Also the apparatus 100 is portable can be used in a confined space and user can set up the apparatus 100 very easily with the help of removably attached handle bars (116 and 120), connector bars (110 and 112), support section and adjustable bars 124. The flexible adjustable bars 124 are easily collapsible and therefore user can fold the whole apparatus 100 by turning the screw 144 and pulling the collapsible sections (126 and 128) of the adjustable bars 124. The ground engaging cushion members 134 in the apparatus 100 provided stability and strength against the counteracting forces.

Although the present invention has been described herein in the context of a particular implementation in a particular environment for a particular purpose, those of ordinary skill in the art will recognize that its usefulness is not limited thereto and that the present invention may be beneficially implemented in any number of environments for any number of purposes. Accordingly, the claims set forth below should be construed in view of the full breadth and spirit of the present invention as described herein. Although specific terms may be employed herein, they are used in a generic and descriptive sense only and not for purposes of limitation.

I claim:

1. A collapsible free standing exercise apparatus, the apparatus comprising: two pairs of hollow vertical bars separated at a predetermined distance via two connector bars, wherein the connector bars are removably fastened at a lower portion of each hollow vertical bar, wherein the first pair of hollow vertical bars is parallel to the second pair of hollow vertical bars, wherein the hollow vertical bars are inclined to each other within each pair but not located in the same plane, wherein an upper vertex joint is defined on each hollow vertical bar; a first handle bar removably fastened to one of two vertex joints of each pair of hollow vertical bars, wherein the first handle bar is used by a first user to perform body weight exercises; a second handle assembly removably fastened between each pair of hollow vertical bars at a predetermined position, wherein the second handle assembly comprises; a second handle bar, wherein the second handle bar is used by a second user to perform body weight exercises; a support section disposed at distal ends of the second handle bar, wherein each end of the support section is removably fastened across each hollow vertical bar within each pair via a pin member and wherein the support section comprises a pin member to removably fasten each end of the second handle bar to a center of the support section, wherein the support section comprises three smaller sections that are inserted into each other to make a distance setting, wherein a plurality of holes disposed in each of the smaller sections of the support section helps to adjust a length of the support section and the smaller sections of the support section are fixed by using one or more fastening members, thereby enabling a user to fix any one of the smaller sections of the support section to define the distance setting between each hollow vertical bar; and an adjustable bar with collapsible sections removably fastened to each hollow vertical bar within each pair at another predetermined position, wherein each adjustable bar comprises plurality of holes to receive a pin member to selectively adjust the length of each adjustable bar, wherein the distance between each hollow vertical bar within the pair is adjusted;

further comprising a ground engaging cushion member fixedly attached to each hollow vertical bar as unified member of the exercise apparatus and removably attached to the connector bars, said ground engaging cushion member comprises a vertical section and an extended horizontal section to define an inverse T-shaped structure, and further comprises a force bearing section, wherein one end of the force bearing section is welded from an end of the extended horizontal section to the vertical section of the ground engaging cushion member to define a shape of a triangle, thereby counteract all the horizontal forces to reduce the horizontal wobble of the free standing exercise apparatus effectively when the user performs the exercise.

2. The collapsible free standing exercise apparatus of claim 1, wherein a fastening section is disposed at one of two vertex joints of each pair of hollow vertical bars.

3. The collapsible free standing exercise apparatus of claim 2, wherein the fastening section comprises a plurality of holes to receive and secure the first handle bar to one of two vertex joints of each pair of hollow vertical bars.

4. The collapsible free standing exercise apparatus of claim 1, wherein each hollow vertical bar comprises a height adjusting mechanism to selectively adjust the position of the second handle assembly on the hollow vertical bars.

5. The collapsible free standing exercise apparatus of claim 1, wherein the ground engaging cushion member is also configured to resist horizontal and gravitational forces generated by the movements of the user during the exercise.

6. The collapsible free standing exercise apparatus of claim 1, wherein the force-bearing section is configured to protect the cohesion between the vertical section and the extended horizontal section of the ground engaging cushion member at each hollow vertical bar of the collapsible free standing exercise apparatus, and resist the moment of the total force of horizontal force and gravitational force generated by the movements of the user during the exercise.

7. The collapsible free standing exercise apparatus of claim 1, wherein the connector bars comprises a first connector bar and a second connector bar to adaptably receive and position each hollow vertical bar on the ground surface, wherein the first connector bar and the second connector bar are configured to have varying dimensions so that when the exercise apparatus is folded, each hollow vertical bar within each pair will be located on a different plane.

8. The collapsible free standing exercise apparatus of claim 7, wherein the first handle bar is removably fastened to one of two vertex joints of each pair of hollow vertical bars via an anti-rotation pin member to prevent the first handle bar to rotate about an axis, wherein the first handle bar is non-rotatable with one of the hollow vertical bars within the pair, and the other hollow vertical bar within the pair is alone to be rotated for folding said apparatus.

9. The collapsible free standing exercise apparatus of claim 1, wherein each hollow vertical bar comprises at least two bars in telescopic engagement with each other to selectively adjust the height of the first handle bar removably fastened to each vertex joint on each pair of hollow vertical bars.

10. A method of assembling a collapsible free standing exercise apparatus for use, the method comprising the steps of: removably fastening two pairs of hollow vertical bars separated at a predetermined distance via two connector bars, wherein the first pair of hollow vertical bars is parallel to the second pair of hollow vertical bars, wherein the hollow vertical bars are inclined to each other within each pair but not located in the same plane, wherein an upper vertex joint is defined on each hollow vertical bar; removably fastening a first handle bar to one of two vertex joints of each pair of hollow vertical bars, wherein the first handle bar is used by a first user to perform body weight exercises; removably fastening a second handle assembly between each pair of hollow vertical bars at a predetermined position, wherein the second handle assembly comprises; a second handle bar, wherein the second handle bar is used by a second user to perform body weight exercises; a support section disposed at distal ends of the second handle bar, wherein each end of the support section is removably fastened across each hollow vertical bar within each pair via a pin member and wherein the support section comprises a pin member to removably fasten each end of the second handle bar to a center of the support section, wherein the support section comprises three smaller sections that are inserted into each other to make a distance setting, wherein a plurality of holes disposed in each of the smaller sections of the support section helps to adjust a length of the support section and the smaller sections of the support section are fixed by using one or more fastening members, thereby enabling a user to fix any one of the smaller sections of the support section to define the distance setting between each hollow vertical bar; and removably fastening an adjustable bar with collapsible sections to each hollow vertical bar within each pair at another predetermined position, wherein each adjustable bar comprises plurality of holes to receive a pin member to selectively adjust the length of each adjustable bar, wherein the distance between each hollow vertical bar within the pair is adjusted;

fixedly attaching a ground engaging cushion member to each hollow vertical bar as unified member of the exercise apparatus and removably attaching it to the connector bars, said ground engaging cushion member comprises a vertical section and an extended horizontal section to define an inverse T-shaped structure, and further comprises a force bearing section, wherein one end of the force bearing section is welded from an end of the extended horizontal section to the vertical section of the ground engaging cushion member to define a shape of a triangle, thereby counteract all the horizontal forces to reduce the horizontal wobble of the free standing exercise apparatus effectively when the user performs the exercise.

11. The method of claim 10, further comprising the step of, fastening the first handle bar to one of two upper vertex joints of each pair of hollow vertical bar via an anti-rotation pin member to prevent the first handle bar to rotate about an axis, wherein the first handle bar is non-rotatable with one of the hollow vertical bars within the pair, and the other hollow vertical bar within the pair is alone to be rotated for folding said apparatus.

12. The method of claim 10, further comprising the step of, inserting the connector bars into the ground engaging cushion members and fastening via a pin member to firmly place the exercise apparatus on a planar surface.

13. The method of claim 10, further comprising the step of, fixedly attaching the force-bearing section to the vertical section and the extended horizontal section of the ground engaging cushion member at each hollow vertical bar of collapsible free standing exercise apparatus at an oblique angle to protect the cohesion between the vertical section and the extended horizontal section of the ground engaging cushion member at each hollow vertical bar of the collapsible free standing exercise apparatus, and resist the moment of the total force of horizontal force and gravitational force generated by the movements of the user during the exercise.

* * * * *